US011640140B2

(12) United States Patent
Haemmerli et al.

(10) Patent No.: US 11,640,140 B2
(45) **Date of Patent: *May 2, 2023**

(54) PROCESS FOR PRODUCING A BALANCE WHEEL FOR A TIMEPIECE

(71) Applicant: The Swatch Group Research and Development Ltd, Marin (CH)

(72) Inventors: Alexandre Haemmerli, Neuchatel (CH); Francois Gueissaz, Cormondreche (CH); Jean-Claude Martin, Montmollin (CH); Lionel Paratte, Neuchatel (CH); Yves Winkler, Schmitten (CH); Gianni Di Domenico, Neuchatel (CH); Pascal Winkler, St-Blaise (CH); Jean-Luc Helfer, Le Landeron (CH); Lionel Tombez, Bevaix (CH); Baptiste Hinaux, Lausanne (CH); Donald William Corson, Yverdon-les-Bains (CH); Michel Willemin, Preles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/669,476

(22) Filed: Feb. 11, 2022

(65) Prior Publication Data

US 2022/0163923 A1 May 26, 2022

Related U.S. Application Data

(63) Continuation of application No. 16/150,524, filed on Oct. 3, 2018, now Pat. No. 11,307,535.

(30) Foreign Application Priority Data

Dec. 22, 2017 (EP) ..... 17210299

(51) Int. Cl.
*G04B 17/22* (2006.01)
*G04B 18/00* (2006.01)
(Continued)

(52) U.S. Cl.
CPC ..... *G04B 17/227* (2013.01); *G04B 17/063* (2013.01); *G04B 17/066* (2013.01);
(Continued)

(58) Field of Classification Search
CPC .. G04B 17/227; G04B 17/063; G04B 17/066; G04B 17/222; G04B 18/006; G04C 3/04; C22C 16/00; C22C 14/00
See application file for complete search history.

(56) References Cited

U.S. PATENT DOCUMENTS 387,973 A 8/1888 Giles
8,550,699 B2 10/2013 Buhler
(Continued)

FOREIGN PATENT DOCUMENTS

CH 621 669 A3 2/1981
CN 101589347 A 11/2009
(Continued)

OTHER PUBLICATIONS

Combined Chinese Office Action and Search Report dated May 20, 2022, in Chinese Patent Application No. 202110265760.5 (with English translation), 19 pages.
(Continued)

*Primary Examiner* — Sean Kayes
(74) *Attorney, Agent, or Firm* — Oblon, McClelland, Maier & Neustadt, L.L.P.

(57) ABSTRACT

A process for producing a metal alloy balance wheel by molding includes a) making a mold in the negative shape of the balance wheel; b) obtaining a metal alloy that has a thermal expansion coefficient of less than 25 ppm/° C. and
(Continued)

is able to be in an at least partly amorphous state when it is heated to a temperature between its glass transition temperature and its crystallization temperature; c) putting the metal alloy into the mold, the metal alloy being heated to a temperature between its glass transition temperature and its crystallization temperature so as to be hot-molded and to form a balance wheel; d) cooling the metal alloy to obtain a balance wheel made of the metal alloy; and e) releasing the balance wheel obtained in step d) from its mold. The process also includes a step for over-molding flexible centering components in the hub.

18 Claims, 3 Drawing Sheets

(51) Int. Cl.

| | |
|---|---|
| ***G04B 17/06*** | (2006.01) |
| *B22C 9/00* | (2006.01) |
| *B22D 15/00* | (2006.01) |
| *B22D 25/02* | (2006.01) |
| *B22D 27/04* | (2006.01) |
| *C22C 14/00* | (2006.01) |
| *C22C 16/00* | (2006.01) |
| *C22C 21/00* | (2006.01) |
| *C22C 38/08* | (2006.01) |
| *G04C 3/04* | (2006.01) |

(52) U.S. Cl.
CPC ..... *G04B 17/222* (2013.01); *G04B 18/006* (2013.01); *B22C 9/00* (2013.01); *B22D 15/00* (2013.01); *B22D 25/026* (2013.01); *B22D 27/04* (2013.01); *C22C 14/00* (2013.01); *C22C 16/00* (2013.01); *C22C 21/00* (2013.01); *C22C 38/08* (2013.01); *G04C 3/04* (2013.01)

(56) References Cited

U.S. PATENT DOCUMENTS

| | | | | |
|---|---|---|---|---|
| 10,981,223 | B2 * | 4/2021 | Carozzani ..... | B22D 27/04 |
| 2002/0180130 | A1 | 12/2002 | Baur | |
| 2014/0064044 | A1 | 3/2014 | Hessler | |
| 2019/0262896 | A1 | 8/2019 | Carozzani | |

FOREIGN PATENT DOCUMENTS

| | | | |
|---|---|---|---|
| CN | 101978327 | A | 2/2011 |
| CN | 2 703 909 | A1 | 3/2014 |
| CN | 103885318 | A | 6/2014 |
| CN | 206178347 | U | 5/2017 |
| CN | 106896695 | A | 6/2017 |
| CN | 107168030 | A | 9/2017 |
| CN | 107168031 | A | 9/2017 |
| CN | 107463082 | A | 12/2017 |
| EP | 2 395 402 | A1 | 12/2011 |
| EP | 3 170 579 | A1 | 5/2017 |
| EP | 3 182 211 | A1 | 6/2017 |
| JP | 2011-526676 | A | 10/2011 |

OTHER PUBLICATIONS

European Search Report dated Jun. 19, 2018 in European Application 17210299.8, filed on Dec. 22, 2017 (with English Translation of Categories of cited documents).
"Material Expansion Coefficients", Laser and Optics User's Manual, 2002, https://psec.uchicago.edu/thermal_coefficients/cte_metals_05517-90143.pdf, 12 pages.
Combined Chinese Office Action and Search Report dated Oct. 27, 2021 in corresponding Chinese Patent Application No. 202110265760.5 (with English Translation and English Translation of Category of Cited Documents), 17 pages.
Google Patent translation of CN 101978327 (Year: 2012).
Combined Chinese Office Action and Search Report dated Oct. 17, 2022 in Chinese Patent Application No. 202110265760.5 (with English translation of Office Action only), 19 pages.

* cited by examiner

PROCESS FOR PRODUCING A BALANCE WHEEL FOR A TIMEPIECE

This application is a continuation of and claims the benefit of U.S. application Ser. No. 16/150,524, filed on Oct. 3, 2018, now U.S. Pat. No. 11,307,535, which claims priority from European patent application No. 17210299.8 filed on Dec. 22, 2017, the entire disclosures of which are hereby incorporated herein by reference.

FIELD OF THE INVENTION

The invention relates to a process for producing a balance wheel for a timepiece comprising a serge, a hub and at least one arm connecting the hub to the aforesaid serge.

BACKGROUND OF THE INVENTION

The oscillator or resonator of a mechanical timepiece consists of a spiral spring and a flywheel called a balance wheel. Temperature changes alter the rigidity of the spiral spring as well as the geometries of the spring and the balance wheel, which modifies the spring constant and the inertia and thus the oscillating frequency. Clock makers have strived to obtain oscillators that are temperature stable, and several avenues have been explored/utilized, one of which won a Nobel Prize for Charles-Edouard Guillaume for the development of the Elinvar alloy, whose modulus of elasticity increases with the temperature and compensates for the increase in the inertia of the balance wheel. Thereafter, the development of oxidized, therefore thermally compensated, silicon surpassed the performance of Elinvar and has the advantage of being less sensitive to magnetic fields. The spiral spring made of single-crystal quartz also allows for thermal compensation of the change of inertia of the balance wheel. But contrary to oxidized silicon, the oxide thickness of which can be varied according to the material of the balance wheel being used, the quartz spiral is limited to materials having a thermal expansion coefficient of about 10 ppm/° C., which for example corresponds to titanium and platinum. The main problem with these materials is machinability and control over the fine structure and/or of a perfect finish (mirror polish for example). In the case of titanium, its relatively low density limits its use for large balance wheels, and in the case of platinum, its high price limits its use to prestige and luxury products.

SUMMARY OF THE INVENTION

It is the object of the present invention to remedy these disadvantages by proposing a balance wheel production process that is performed with new materials allowing for simpler and more precise manufacture, so as to, for example, reduce the variation in momentum and/or variability within the same production batch.

To this end, the invention relates first of all to a balance wheel production process for a timepiece comprising a serge, a hub and at least one arm connecting the hub with the aforesaid serge, the serge, the hub and the arms being made of a metal alloy, with the aforesaid process comprising the following steps:

a) making a mold in the negative shape of the balance wheel;

b) obtaining a metal alloy that has a thermal expansion coefficient of less than 25 ppm/° C. and is capable of being in an at least partly amorphous state when it is heated to a temperature between its glass transition temperature and its crystallization temperature;

c) putting the metal alloy into the mold, said metal alloy being heated to a temperature between its glass transition temperature and its crystallization temperature so as to be hot-molded and to form a balance wheel;

d) cooling said metal alloy to obtain a balance wheel made of said metal alloy; and e) releasing the balance wheel obtained in step d) from its mold.

The present invention also concerns a process for producing a balance wheel for a timepiece comprising a serge, a hub and at least one arm connecting the hub to the aforesaid serge, the hub and the arm being made of a metal alloy, and the serge being made of a material having a higher density than the density of the aforesaid metal alloy of which the hub and the arm are made, said process comprising the following steps:

a) making a mold in the negative shape of the balance wheel;

a') inserting a serge or serge parts made of a material that has a density higher than the density of the aforesaid metal alloy into the mold;

b) obtaining a metal alloy that has a thermal expansion coefficient of less than 25 ppm/° C. and is able to exist in an at least partly amorphous state when it is heated to a temperature between its glass transition temperature and its crystallization temperature;

c) putting the metal alloy into the mold, said metal alloy being heated to a temperature between its glass transition temperature and its crystallization temperature so as to be hot-molded, and over-molding the serge or the parts of the serge so as to mold a balance wheel with inserts;

d) cooling said metal alloy so as to obtain a balance wheel with inserts; and e) releasing the balance wheel obtained in step d) from its mold.

Thanks to the properties of amorphous metals, a metal alloy balance wheel can be produced by using a simplified manufacturing process, such as a casting process or a hot-molding process. Moreover, it is a property of a metal alloy in its at least partly amorphous form to have an elastic deformation range that is significantly wider than its crystalline equivalent, thanks to the absence of dislocations. This property makes it possible to over-mold or integrate elements that make it possible to improve centering as well as to control inertia and/or unbalance in the balance wheel.

SUMMARY DESCRIPTION OF THE DRAWINGS

Other characteristics and advantages will be made evident by the subsequent description provided only for indicative and by no means restrictive purposes, referring to the attached drawings.

DETAILED DESCRIPTION OF THE PREFERRED EMBODIMENTS

Figure 1:
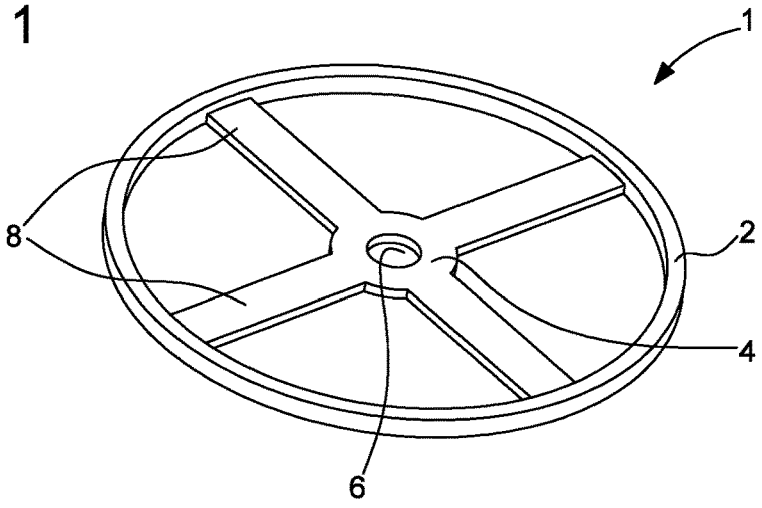
FIG. 1 is a perspective view of a balance wheel produced according to this invention.

FIG. 1 shows a balance wheel 1 for a time piece. Such a balance wheel 1 traditionally comprises a continuous or non-continuous serge 2 which defines the outside diameter of the balance wheel 1, a hub 4 constituting its central part and containing a hole 6 defining the pivot point of the balance wheel 1, which hole is to receive a shaft (not shown). The hub 4 is jointly connected to the serge 2 by the arms 8. In this instance there are four arms 8 at 90° from each other. There are also balance wheels with two or three arms, laid out respectively at 180° or 120°.

According to a first embodiment, the serge 2, the hub 4 and the arms 8 are made of the same metal alloy. The balance wheel 1 is advantageously a one-piece part, i.e. it is made in one piece.

The balance wheel 1 can for example be made entirely in an alloy containing platinum or palladium as described in detail hereafter. Since platinum has a particularly high density (21,000 kg/m3), the platinum alloy used in the invention also has a high density (15.5 g/cm3), so that it is not absolutely necessary to add parts made of elements having a high density to increase the inertia of the balance wheel.

To this end, in accordance with a first embodiment of the invention, the process for producing a balance wheel 1, in which the serge 2, the hub 4 and the arm 8 are made of the same metal alloy, comprises the following steps:

a) making a mold in the negative shape of the balance wheel 1, including possible decorative surface structures;

b) obtaining a metal alloy having a thermal expansion coefficient that is typically lower than 25 ppm/° C. and is able to be in an at least partly amorphous state when it is heated to a temperature between its glass transition temperature and its crystallization temperature;

c) putting the metal alloy into the mold, said metal alloy being heated to a temperature between its glass transition temperature and its crystallization temperature so as to be hot-molded and to form a balance wheel;

d) cooling the aforesaid metal alloy to obtain a balance wheel 1 made of the aforesaid metal alloy; and e) releasing the balance wheel 1 obtained in step d) from its mold.

The cooling step d) can be performed at a cooling rate selected so as to obtain a crystalline, partly amorphous or entirely amorphous alloy.

The balance wheel 1 can, for example, also be entirely made of an alloy containing titanium or zirconium which is described in detail hereafter. Since zirconium, for example, has a lower density, the zirconium alloy used in the invention also has a lower density (6.5 g/cm3), so that the addition of parts made of a denser material to increase the inertia of the balance wheel is recommended, in particular if one wishes to make a balance wheel having a small size for small movements. These parts make it possible to increase the inertia of the balance wheel while maintaining an aesthetic serge geometry and good aerodynamic properties.

Figure 2:
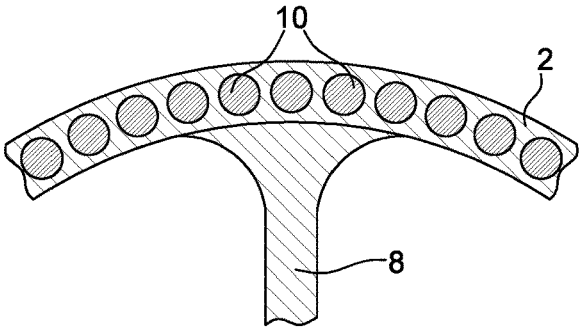
FIG. 2 is a partial top view of an alternative balance wheel produced according to this invention.

Thus, according to a first alternative shown in FIG. 2, the serge 2 can comprise first over-molded inertia adjusting parts 10, said first inertia adjusting parts 10 being made of a material that has a density that is higher than the density of the metal alloy. These first inertia adjusting parts 10 can, for example, be made of tungsten or tungsten carbide and are obtained by over-molding.

To accomplish this, the process of this invention includes a step for over-molding the aforesaid first inertia adjusting parts 10 into the serge 2 by means of inserts placed into the mold before the metal alloy is introduced and over-molded, said first inertia adjusting parts 10 being made of a first material having a density higher than the density of the aforesaid metal alloy.

According to a second embodiment, the arms and the hub of the balance wheel are made of a metal alloy, the serge being made of a material having a higher density than the density of the aforesaid metal alloy used for the arms and the hub. This material can itself be the metal alloy containing platinum or of palladium as defined below or another material. The arms and the hub of the balance wheel are, for example, made of an amorphous metal alloy containing zirconium as defined below, so as to allow the balance wheel to be paired with a spiral spring preferably made of single-crystal quartz, and, in order to improve the inertia of the balance wheel, the serge is made of another material having a density higher than the density of the zirconium containing metal alloy used for the arms and the hub.

To accomplish this, in accordance with a second embodiment of the invention, the process for producing a balance wheel for a timepiece wherein the hub 4 and the arms 8 are made of a metal alloy, and a serge 2 is made of a second material having a density higher than the density of the aforesaid metal alloy of which the hub 4 and the arms 8 are made, comprises the following steps:

a) making a mold in the negative shape of the balance wheel;

a') inserting a serge or serge parts made of a material that has a density higher than the density of the aforesaid metal alloy into the mold;

b) obtaining a metal alloy that has a thermal expansion coefficient of less than 25 ppm/° C. and is able to be in an at least partly amorphous state when it is heated to a temperature between its glass transition temperature and its crystallization temperature;

c) putting the metal alloy into the mold, said metal alloy being heated to a temperature between its glass transition temperature and its crystallization temperature so as to be hot molded and over-molding the serge or the serge parts so as to mold a balance wheel with inserts;

d) cooling said metal alloy so as to obtain a balance wheel with inserts; and e) releasing the balance wheel obtained in step d) from its mold.

The cooling step d) of can be performed at a cooling speed selected so as to obtain a crystalline, partly amorphous or entirely amorphous alloy.

The processes of the invention according to the first or second embodiments advantageously make use of the properties of a metal alloy capable of being, at least partly, in an amorphous form when it is heated, so as to produce a balance wheel made of a metal alloy.

Indeed, a metal alloy capable of being in an at least partly amorphous form when it is heated allows for great facility in molding by allowing parts having a complex shape to be produced with a higher degree of accuracy. This is because of the particular characteristics of "amorphous metals," which can soften while remaining amorphous for a certain amount of time in a particular temperature interval [Tg-Tx] specific to each alloy (for example for an alloy containing Zr: Tg=440° C. and Tx=520° C.). It is thus possible to shape them under relatively low stress and at a temperature that is not very high, thus allowing for a simplified process, such as hot-forming, to be used. The utilization of such a material moreover makes it possible to very precisely reproduce fine geometries rapidly as a function of the temperature within the temperature interval [Tg-Tx] and the alloy thus takes on all of the details of the negative. For example, for a material containing platinum as defined below, the molding is performed at around 300° C., with the viscosity reaching 103 Pa·s and under a pressure of 1 MPa, instead of a viscosity of 1012 Pa·s at the temperature Tg. The use of molds has the advantage of producing three-dimensional parts with great precision, which cannot be accomplished by cutting or stamping.

A process used advantageously is the forming of an amorphous preform. This preform is obtained by fusing metal components that are to constitute the metal alloy in a furnace. This fusion is performed under a controlled atmosphere with the goal of obtaining a level of oxygen contamination of the alloy that is as low as possible. Once these components have melted, they are cast into the shape of the semi-finished product, then quickly cooled in order to partially or completely maintain the amorphous state. Once the preforming has been accomplished, hot forming is carried out with the aim of obtaining a definitive part. The hot-molding is performed by pressing in a temperature range between the glass transition temperature Tg and the crystallization temperature Tx of the metal alloy for a period of time such that an at least partly amorphous structure is preserved. This is done with the intent of preserving the elastic properties characteristic of amorphous metals.

In the case of an alloy containing Zr and at a temperature of 440° C., the pressing time will typically not have to exceed approximately 120 seconds. Hot-molding thus makes it possible to preserve the initial amorphous state of the preform. The various steps of shaping the cast solid balance wheel according to the invention are then:

1) heating of the molds having the negative shape of the balance wheel to a selected temperature, 2) introducing the amorphous metal preform between the hot molds, 3) applying of a clamping force to the molds in order to impart the geometry of the latter onto the amorphous metal preform, 4) waiting for a preselected maximum time, 5) opening the molds, 6) cooling the balance wheel, and 7) removing the balance wheel from the molds.

The balance wheel can of course also be produced by casting or injection. This process consists of casting or injecting the heated metal alloy at a temperature between its glass transition temperature and its crystallization temperature such that it can be at least partly amorphous into a mold having the shape of the final part.

The mold can be reused or dissolved to release the parts. The molding process has the advantage of replicating the geometry of the balance wheel perfectly, including possible decorations or surface structuring. A smaller degree of variation of the inertia and centering in a production lot of balance wheels is obtained. The process of molding makes it possible to obtain a balance wheel with an aesthetic geometry, keen interior angles, a serge profile and/or a convex arm profile, and a perfect finish. It is also possible to provide for a non-continuous serge. To achieve a maximum quality, the mold will be made of silicon by a DRIE [Deep Reactive Ion Etching] process. It is self-understood that the mold can also be constructed by machine milling, laser machining, electro-erosion or any other kind of machining.

The elastic properties that are characteristic of amorphous metals are used to over-mold or to integrate functional and/or decorative elements in the serge and/or on the level of the arms and/or the level of the hub, for example by means of appropriate inserts placed into the mold before the heated metal alloy is introduced between its glass transition temperature and its crystallization temperature so that it is at least partly amorphous.

Figure 3:
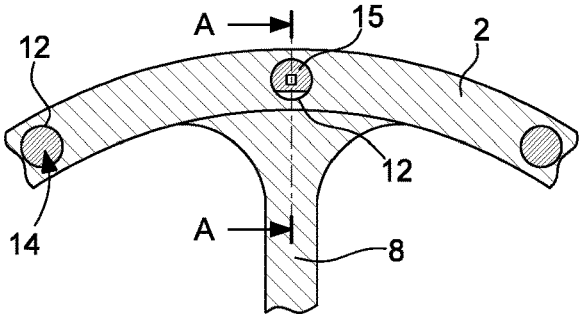
FIG. 3 is a partial top view of another alternative balance wheel produced according to this invention.
Figure 4:
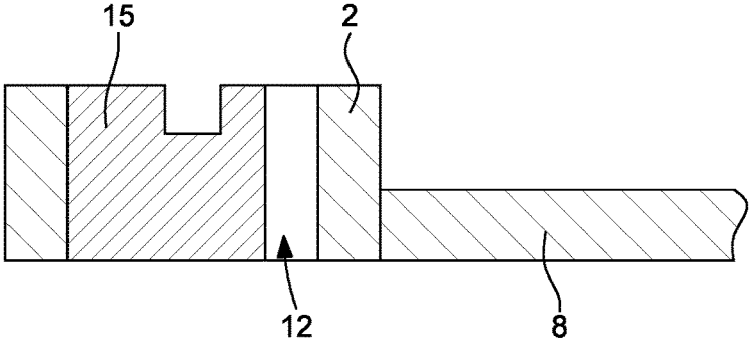
FIG. 4 is a cross-section along axis A-A of FIG. 3.

Independently of the first or second embodiments of the processes of the invention, the serge 2 can include recesses 12 designed to receive second components for adjusting the inertia and/or the imbalance 14, 15 as shown in FIG. 3. These recesses 12 can advantageously be provided during the production of the balance wheel 1 by molding in accordance with the processes of the invention. The second components for adjusting the inertia and/or the imbalance 14, 15 can, for example, be counterweights, cleft counterweights, pins 14, cotter pins, or imbalance adjusting pins 15, which act as counterweights. These parts are chased or clamped into the corresponding recesses 12. FIG. 3 shows a pin 14 inserted in its recess 12, as well as an imbalance adjusting pin 15 inserted in its recess 12. FIG. 4 shows a cross-section along the line A-A of FIG. 3, showing the imbalance adjusting pin 15 inserted into the recess 12 of the serge 2.

It is self-evident that these components for increasing the inertia of the balance wheel are preferably used with a serge made of a material having a low density, such as titanium or zirconium, but they can also be used with a serge made of another material.

To increase the inertia of the balance wheel, it is also possible to provide for a thicker or wider serge, particularly in the case of larger balance wheels.

The recesses 12 shown in FIG. 3 can also be recesses designed to receive aesthetic and/or luminescent elements, such as tritium tubes (not shown), or capsules of phosphorescent (of the Superluminova type, for example) or fluorescent materials.

According to another version of the invention, one or another of the steps of the processes includes a step for over-molding flexible centering components 16, 17 onto the hub 4, its outside circumference or its surface. The hub 4 can thus include integrated flexible centering components which allow for self-centering of the balance wheel during its assembly to an axis, thanks to the elastic deformation of the aforesaid flexible centering components.

Figure 5:
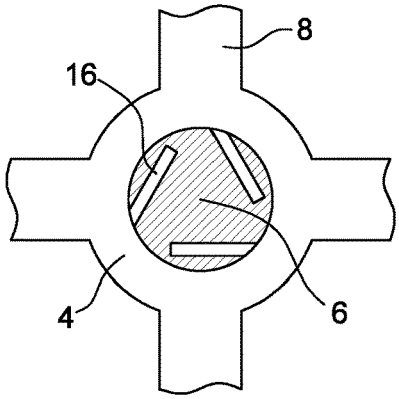
FIGS. 5 to 10 are partial top views of other balance wheel alternatives produced according to this invention.
Figure 6:
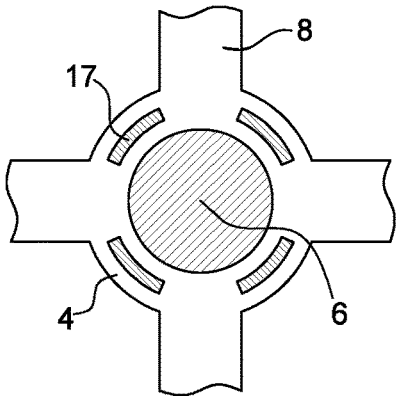

According to FIG. 5, the aforesaid integrated flexible centering components 16 are elastic strips shown inside the inner circumference of the hub 4 so that they are located in the hole 6. According to FIG. 6, the aforesaid integrated flexible centering components 17 are located on the surface of the hub 4 and are distributed around the hole 6. The flexible centering elements 16 and 17 can advantageously be inserted during the production of the balance wheel 1 by molding in accordance with the processes of this invention.

According to another version of the invention, one or the other of the processes includes a step for over-molding third flexible inertia adjusting components 19, 20, 22*a*, 22*b* in the arm 8. At least one of the arms 8 thus carries third integrated flexible inertia adjusting elements.

Figure 7:
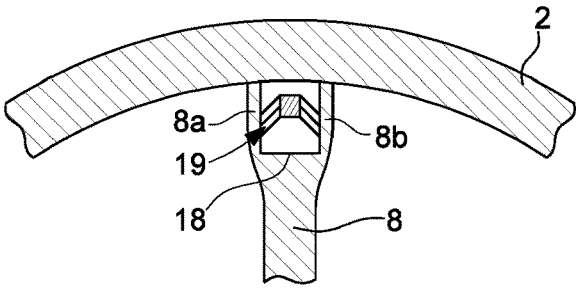

According to FIG. 7, the end of the arm 8 on the side of the serge 2 ends in two branches 8*a*, 8*b* forming a space 18 between them into which a third "V"-shaped flexible bistable inertia adjusting element 19 is integrated for purposes of adjusting the frequency.

Figure 8:
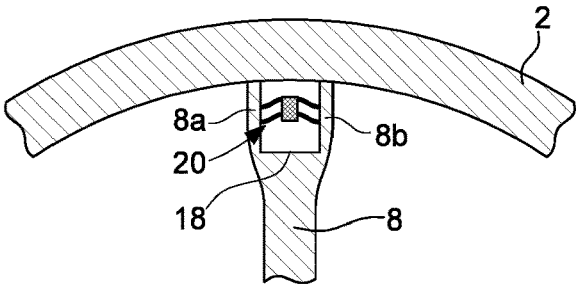

According to FIG. 8, the space 18 contains a third flexible inertia adjusting component 20 for purposes of adjusting the frequency. To this end, the third inertia adjusting component 20 is made of a material, such as silicon or silicon oxide, having different expansion properties than the metal alloy of the balance wheel of the invention.

Figure 9:
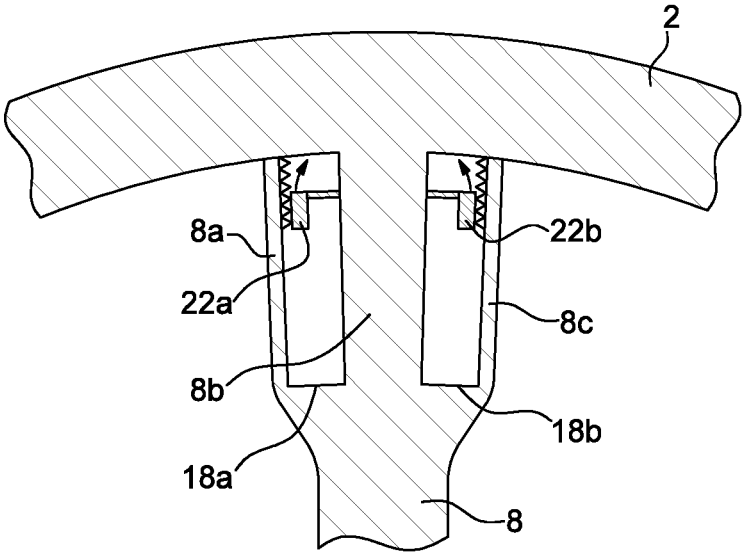

According to FIG. 9, the end of the arm 8 on the side of the serge 2 ends in three branches 8*a*, 8*b*, 8*c* forming two spaces 18*a*, 18*b* between them in which third flexible multi-stable inertia adjusting ratchet parts 22*a*, 22*b* are integrated for purposes of adjusting the frequency.

These third flexible inertia adjusting parts 19, 20, 22*a*, 22*b* for adjusting the frequency can also be advantageously put in place during the production of the balance wheel 1 by molding in accordance with the processes of the invention.

These third flexible inertia adjusting parts 19, 20, 22*a*, 22*b* for adjusting the frequency can be employed when the whole of the balance wheel is made of the same metal alloy as well as when the arms are made of one metal alloy and the rest of the balance wheel, in particular the serge, is made of another material.

Figure 10:
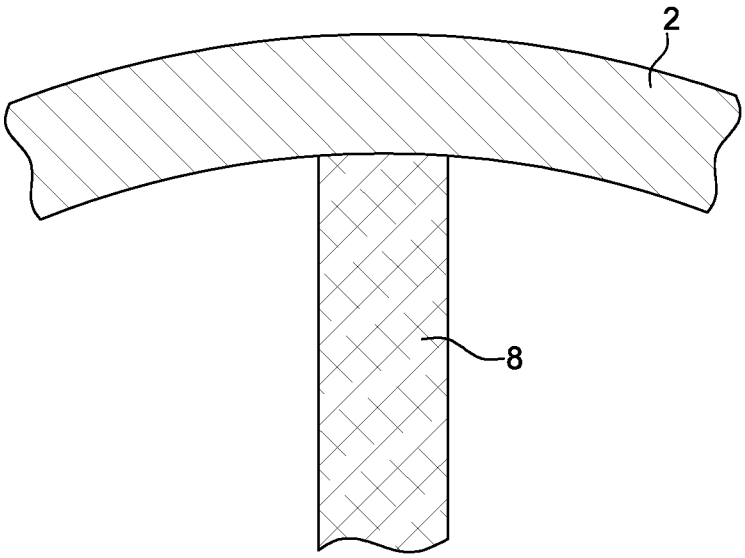

According to another alternative of the invention, a mold with microstructures that form a decoration or a photonic network is used in one or the other of the processes of the invention. Thus, one of the arms 8 of the serge 2 and of the hub 4 has a structured surface quality. Only one of the parts can have a structured surface quality or all of the parts of the balance wheel can have a structured surface quality, with this structured surface quality being identical or different. FIG. 10 shows a balance wheel of the invention where the serge 2 has a structured surface quality that is different from the structured surface quality of the arm 8. This structured surface quality can be a polished, glossed, sanded, beaded, sunlit, etc. state. It is also possible to provide microstructures forming a photonic network in the mold for the production of the balance wheel, so as to replicate these microstructures on the surface of the balance wheel. These microstructures can make it possible to create a photonic crystal lending the part a certain color, a hologram or a diffractive pattern which can constitute an anti-counterfeiting feature. These structures are introduced directly into the mold and are replicated during the production of the balance wheels by hot-forming, which does not require any additional finishing operations. It is also possible to add a logo to the mold.

The metal alloy used in the processes of the invention has a thermal expansion coefficient that is typically smaller than 25 ppm/° C. and greater than 7 ppm/° C. and is able to exist in an at least partly amorphous state when it is heated to a temperature between its glass transition temperature and its crystallization temperature.

The metal alloy used in the processes of the invention is preferably based on an element selected from among the group comprising platinum, zirconium, titanium, palladium, nickel, aluminum and iron.

In the present description, the expression "based on an element" means that the aforesaid metal alloy contains at least 50% by weight of the aforesaid element.

The aforesaid metal alloy used in the present invention can be based on platinum and can have a thermal expansion coefficient of less than 12 ppm/° C., preferably between 8 ppm/° C. and 12 ppm/° C.

Such a metal alloy based on platinum can be made of, in atomic % values, a platinum base, whose concentration constitutes the balance,
13 to 17% copper,
3 to 7% nickel, and
20 to 25% phosphorus.

The metal alloy used in the present invention can also be based on zirconium and can have a thermal expansion coefficient of less than 12 ppm/° C., preferably between 8 ppm/° C. and 11 ppm/° C.

Such a metal alloy based on zirconium can be made of, in atomic % values, a zirconium base, whose concentration constitutes the balance,
14 to 20% copper,
12 to 13% nickel,
9 to 11% aluminium, and
2 to 4% niobium.

The metal alloy used in the present invention can also be based on palladium and can have a thermal expansion coefficient of less than 20 ppm/° C., preferably between 13 ppm/° C. and 18 ppm/° C.

Such a metal alloy containing palladium can be made of, in atomic % values, a palladium base, whose concentration constitutes the balance,
25 to 30% copper,
8 to 12% nickel, and
18 to 22% phosphorus.

The alloys used in the invention ideally do not contain any impurity. However, they can include traces of impurities which can often inevitably derive from the preparation of the aforesaid alloys.

If the alloys used in the present invention have a thermal expansion coefficient that is smaller than 12 ppm/° C. and greater than 8 ppm/° C., they can be used to produce at least part of a balance wheel which will be paired with a spiral spring, preferably of single-crystal quartz. The alloys used in the present invention having a thermal expansion coefficient that is smaller than 20 ppm/° C. and greater than 13 ppm/° C. can be used to produce at least a part of a balance wheel which will be paired with a spiral spring made of a metal or silicon.

More preferably, said metal alloy based on platinum used in the present invention consists, in atomic % values, of:

57.5% Pt, 14.7% Cu, 5.3% Ni, and 22.5% P.

Such an alloy has a thermal expansion coefficient between 11 and 12 ppm/° C.

The aforesaid metal alloy based on zirconium used in the present invention more preferably consists, in atomic % values, of:

58.5% Zr, 15.6% Cu, 12.8% Ni, 10.3% Al, and 2.8% Nb.

Such an alloy has a thermal expansion coefficient between 10.5 and 11 ppm/° C.

The aforesaid metal alloy based on palladium used in the present invention more preferably consists, in atomic % values, of 43% Pd, 27% Cu, 10% Ni, and 20% P.

Such an alloy has a thermal expansion coefficient between 15 and 16 ppm/° C.

The balance wheel of this invention is thus made of a material that makes it possible to use a simple production process while having a thermal expansion coefficient allowing them to be paired with a spiral spring made of single-crystal quartz and/or metal or silicon, preferably of single-crystal quartz. The balance wheel according to the invention also makes it possible to at least have arms having a thermal expansion coefficient that allows it to be paired with a spiral spring of single-crystal quartz and/or metal or silicon, while also having high inertia by maintaining a compact and aesthetic serge geometry with a small volume by means of an adequate serge, either including a component made of a material of higher density, or itself being made of a material of higher density.

What is claimed is:

1. A process for producing a balance wheel for a timepiece comprising a serge, a hub and at least one arm connecting the hub to said serge, the serge, the hub and the arm being made of a metal alloy, said process comprising the following steps:

a) making a mold in the negative shape of the balance wheel b) obtaining a metal alloy that has a thermal expansion coefficient of less than 25 ppm/° C. and is able to be in an at least partly amorphous state when it is heated to a temperature between its glass transition temperature and its crystallization temperature c) putting the metal alloy into the mold, said metal alloy being heated to a temperature between its glass transition temperature and its crystallization temperature so as to be hot molded and to form a balance wheel d) cooling said metal alloy to obtain a balance wheel made of said metal alloy e) releasing the balance wheel obtained in step d) from its mold, wherein the process includes a step for over-molding flexible centering components in the hub.

2. The process according to claim 1, wherein it includes a step of over-molding first inertia adjusting components in the serge, said first inertia adjusting components being made of a first material having a density that is greater than the density of said metal alloy.

3. The process according to claim 1, wherein the serge includes recesses designed to receive second inertia adjusting and/or unbalance compensating components.

4. The process according to claim 1, wherein the serge includes recesses designed to receive decorative and/or luminescent elements.

5. The process according to claim 1, wherein said centering components are located on an inside circumference of the hub.

6. The process according to claim 1, wherein it includes a step to over-mold third flexible inertia adjusting components in the arm.

7. The process according to claim 1, wherein the mold has microstructures forming a decor or a photonic network.

8. The process according to claim 1, wherein said metal alloy is based on an element selected from among the group consisting of platinum, zirconium, titanium, palladium, nickel, aluminum and iron.

9. The process according to claim 1, wherein said metal alloy is based on platinum and has a thermal expansion coefficient of less than 12 ppm/° C.

10. The process according to claim 9, wherein said metal alloy is based on platinum and has a thermal expansion coefficient between 8 ppm/° C. and 12 ppm/° C.

11. The process according to claim 9, wherein the metal alloy based on platinum is made, in atomic % values, of a base of platinum, whose concentration constitutes the balance, 13 to 17% copper, 3 to 7% nickel, and 20 to 25% phosphorus.

12. The process according to claim 1, wherein said metal alloy is based on zirconium and has a thermal expansion coefficient that is smaller than 12 ppm/° C.

13. The process according to claim 12, wherein said metal alloy is based on zirconium and has a thermal expansion coefficient between 8 ppm/° C. and 11 ppm/° C.

14. The process according to claim 12, wherein the metal alloy based on zirconium is made, in atomic % values, of a base of zirconium, whose concentration constitutes the balance, 14 to 20% copper, 12 to 13% nickel, 9 to 11% aluminium, and 2 to 4% niobium.

15. The process according to claim 1, wherein said metal alloy is based on palladium and has a thermal expansion coefficient that is less than 20 ppm/° C.

16. The process according to claim 15, wherein said metal alloy is based on palladium and has a thermal expansion coefficient that is between 13 ppm/° C. and 18 ppm/° C.

17. The process according to claim 15, wherein the metal alloy based on palladium is made, in atomic % values, of a base of palladium, whose concentration constitutes the balance, 25 to 30% copper, 8 to 12% nickel, and 18 to 22% phosphorus.

18. A process for producing a balance wheel of a timepiece comprising a serge, a hub and at least one arm connecting the hub to said serge, the hub and the arm being made of a metal alloy, and the serge being made of a second material having a density that is greater than the density of said metal alloy of which the hub and the arm are made, said process including the following steps:

a) making a mold in the negative shape of the balance wheel;

a') inserting a serge or serge parts made of a material that has a density higher than the density of said metal alloy into the mold;

b) obtaining a metal alloy that has a thermal expansion coefficient of less than 25 ppm/° C. and is able to be in an at least partly amorphous state when it is heated to a temperature between its glass transition temperature and its crystallization temperature;

c) putting the metal alloy into the mold, said metal alloy being heated to a temperature between its glass transition temperature and its crystallization temperature so as to be hot-molded, and over-molding the serge or the parts of the serge so as to mold a balance wheel with inserts;

d) cooling said metal alloy so as to obtain a balance wheel with inserts; and e) releasing the balance wheel obtained in step d) from its mold, wherein the process includes a step for over-molding flexible centering components in the hub.

* * * * *